US006481183B1

(12) United States Patent
Schmidt

(10) Patent No.: US 6,481,183 B1
(45) Date of Patent: Nov. 19, 2002

(54) VERTICAL FORM FILL SEAL BAG WITH RECLOSEABLE SEAL AND METHOD OF MAKING THEREOF

(75) Inventor: John A. Schmidt, Appleton, WI (US)

(73) Assignee: CMD Corporation, Appleton, WI (US)

( * ) Notice: Subject to any disclaimer, the term of this patent is extended or adjusted under 35 U.S.C. 154(b) by 0 days.

(21) Appl. No.: 09/556,603

(22) Filed: Apr. 21, 2000

(51) Int. Cl.[7] ..... B65B 61/18

(52) U.S. Cl. ..... 53/412; 53/46; 53/133.4; 53/139.2; 493/2.3; 493/214; 493/927; 383/63; 383/64

(58) Field of Search ..... 53/412, 416, 133.4, 53/139.2; 493/213, 214, 927; 156/66; 383/63, 64

(56) References Cited

U.S. PATENT DOCUMENTS 4,655,862 A 4/1987 Christoff et al.
4,840,012 A 6/1989 Boeckmann
4,909,017 A 3/1990 McMahon et al.
5,014,499 A * 5/1991 Boeckmann ..... 53/451
5,832,701 A * 11/1998 Hauers et al. ..... 53/551
5,862,652 A 1/1999 Schoeler
6,126,318 A * 10/2000 Bell ..... 383/209
6,178,722 B1 * 1/2001 McMahon ..... 53/412
6,206,571 B1 * 3/2001 Olin ..... 383/204

* cited by examiner

*Primary Examiner*—Rinaldi I. Rada
*Assistant Examiner*—Gloria R Weeks
(74) *Attorney, Agent, or Firm*—George R. Corrigan

(57) ABSTRACT

A vertical form fill seal, stand-up, bag and a method of making the same is disclosed. The bag made of a flexible and resilient material such as plastic, has hollow interior, a horizontal bottom seal located below the hollow interior and a top horizontal seal located above the hollow interior. The bag can stand, preferably on or near the bottom seal, when filled with contents. A recloseable seal, such as a finger closure zipper or a slide zipper in other embodiments, is on a perimeter of the hollow interior, and between the top and bottom seals. The recloseable seal extends in a direction other than horizontal, and may extends the entire distance, or only a part of the distance, between the top horizontal seal and the bottom horizontal seal. The recloseable seal is fixed to sealed horizontal sides, or other than the sealed horizontal sides, and may be flush with the bag or extending beyond the edges of the bag. The bag has a handle above the top horizontal seal.

21 Claims, 8 Drawing Sheets

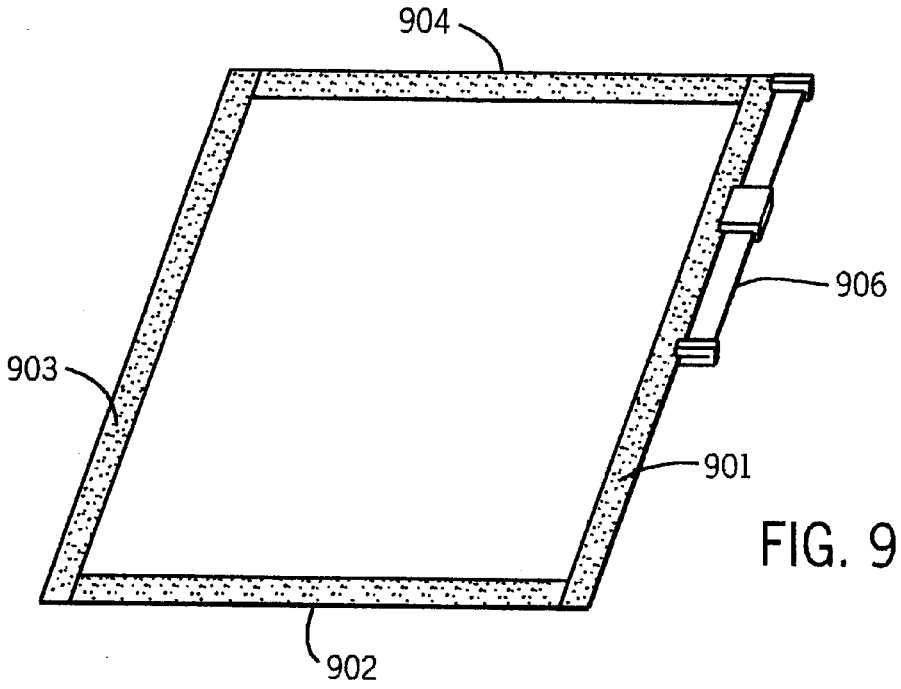
FIG. 9
FIG. 10
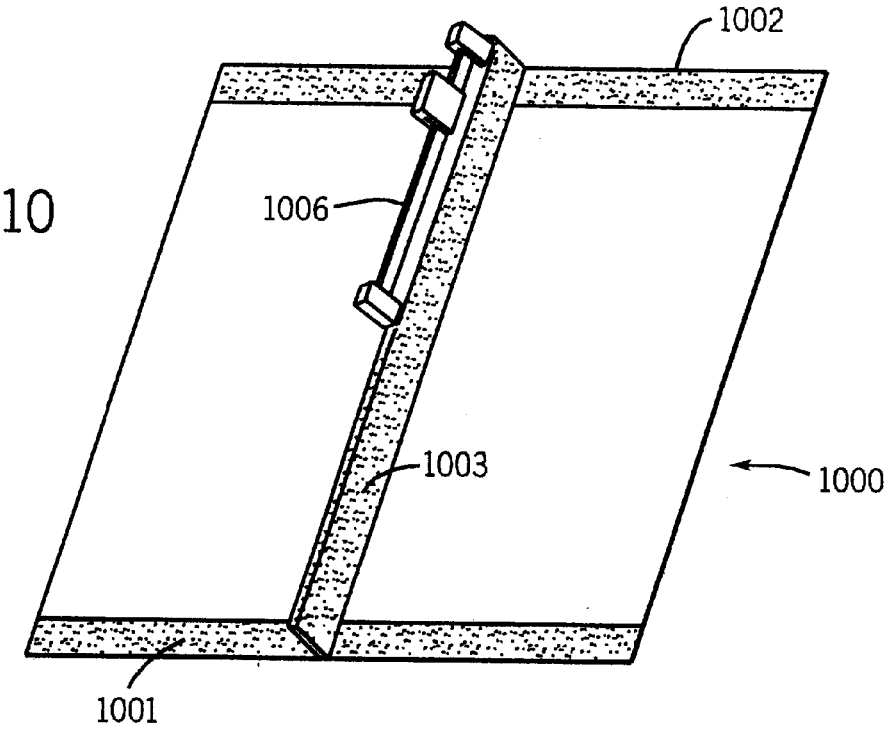

VERTICAL FORM FILL SEAL BAG WITH RECLOSEABLE SEAL AND METHOD OF MAKING THEREOF

FIELD OF THE INVENTION

The present invention relates generally to the art of sealed bags. More specifically, it relates to bags having a recloseable seal, such as a finger closure zipper or a slide zipper.

BACKGROUND OF THE INVENTION

Resilient flexible bags, such as plastic or poly bags, are well known in the art. Some known bags include resealable or refastenable closures, such as a finger closure zipper or a slide zipper. (Finger closure zipper, as used herein, includes seals that are closed by applying pressure, such as by the user's fingers, and squeezing together and mating the open sides of the seal or fastener strips. Slide zipper, as used herein, includes seals that are closed by sliding a closing device along the open seals that applies pressure, squeezing together and mating the open sides of the seal or fastener strips.)

Various type of bags are well known in the art, including vertical form fill seal styles of pillow bags, square bottom bags, and pre-made pouches. A vertical form fill seal bag is typically made by leading a length or strip of plastic film down over a tube with the lateral edges brought together and seamed to form a side seam, thus creating a hollow strip. If the tube is curved, the hollow strip will have a curved cross section. A cross-seam is created to form the bottom of a bag and contents are normally dropped in the bag through the tube about which the film is formed. A cross seam seals the top of the bag (which can be formed with the bottom. seal of the following bag), and the filled bag is separated from the film. Pillow bags are bags with three or four seals, and the shape of the bag conforms to the material in the bag, much as a pillow case conforms its shape to the stuffing in the pillow. Pre-made pouches are bags, of any style, made prior to filling, and then filled and sealed (often at a remote location). These exemplary types of bags are well known, as are various methods and machines to make them. Known bags may be made with different types of closures, including resealable closures or non-resealable closures.

One example of a finger closure zipper on a vertical form fill seal bag is found in U.S. Pat. No. 4,840,012, entitled Zippered Film Feed, and issued Jun. 20, 1989 (incorporated herein by reference). A finger closure zipper is attached to the vertical form fill seal bags in the longitudinal (machine) direction along the full length of the bags, from the top to the bottom seals. While this type of bag allows for a side resealable closure, the zipper extends substantially the entire length of the bag, thus costing more for the zipper, and allowing for spillage of the packed material when the zipper is fully opened.

Horizontal zipper are full-length (from top to bottom seal) in the prior art because of the difficulty in apply a partial zipper. Such difficulties include registration and heating both the zippered portion and the unzippered portion to a proper temperature when sealing. Also, horizontal zippers are slide zippers in the prior art because it is difficult to apply the zipper ends and slider horizontally, (or longitudinally).

Other examples of finger closure zippers on a vertical form fill seal bags are found in U.S. Pat. No. 4,909,017, issued Mar. 20, 1990, entitled Reclosable Bag Material, Method and Apparatus, and U.S. Pat. No. 4,655,862, entitled Method Of And Means For Making Reclosable Bags And Method Therefor, issued Apr. 7, 1987, both of which are incorporated by reference herein. These patents describe a finger closure zipper in the cross web direction. The closure is applied to the top of a bag. These patents use a zipper across the full width of the bag, and are thus not economical. Additionally, the bags described therein are not stand-up bags, i.e., when filled they do no stand on their own on a surface generally near the bottom seal.

The bags described above are not easy to pour from—the resealable closure is on either the top, or all the way down the side of the bag. In either case, it is difficult to pour without spilling from such a bag when the closure is open. Also, pouring is difficult because the bags do not have handles to grasp while pouring.

U.S. Pat. No. 5,862,652, entitled Tubular Bagging Machine With An Asymmetrical Forming Shoulder And Tubular Bags With An Edge-side Longitudinal Seam Attached, issued Jan. 26, 1999 (incorporated herein by reference) shows a vertical form fills seal bag machine that produces stand-up bags. It does not show a resealable closure, in either the machine or cross directions.

Thus, a bag with a longitudinal resealable seal, that is economical and reduces the likelihood of spillage when opened is desirable. Preferably the bag will be a stand-up bag, and can be made using a wide variety of designs, and may have a handle to assist in pouring.

SUMMARY OF THE PRESENT INVENTION

According to a first aspect of the invention a method of making a vertical form fill seal, stand-up, bag includes forming a hollow strip and moving the hollow strip in a vertical direction. The hollow strip is sealed, creating a horizontal bottom seal, on which the bag can stand when filled with contents. The bag is filled bag with the contents, and a top horizontal seal is made. A recloseable seal, in a direction other than horizontal, is applied to the bag. The bag is also separated from the hollow strip.

Forming the hollow strip includes forming a flexible and resilient hollow strip, and/or a plastic hollow strip in various alternative embodiments.

The recloseable seal is applied for at most a portion of the distance between the top horizontal seal and the bottom horizontal seal, or the entire distance between the top horizontal seal and the bottom horizontal seal, in other embodiments The recloseable seal is applied in a vertical direction, between vertical and horizontal, or horizontal in various embodiments.

A handle portion is formed above the top horizontal seal, and not filled with contents in another embodiment. Preferably, a hole is made in the handle portion.

The hollow strip is formed with a curved cross-section, and/or a cross-section with corners in other embodiments.

The hollow strip is made by sealing horizontal sides of a flat strip. The recloseable seal is applied to a portion of the strip other than the sealed horizontal sides in another embodiment.

A finger closure zipper or a slide zipper are applied in various embodiments.

A notch, extending along a length of the sealed horizontal sides is created in another embodiment. The recloseable seal is applied to the notch.

According to a second aspect of the invention a vertical form fill seal, stand-up, bag includes a hollow interior, a horizontal bottom seal located below the hollow interior and a top horizontal seal located above the hollow interior. The bag can stand, preferably on or near the bottom seal, when filled with contents. A recloseable seal is on a perimeter of the hollow interior, and between the top and bottom seals. The recloseable seal extends in a direction other than horizontal.

The bag is further comprised of a flexible and resilient material and/or plastic in various embodiments.

The recloseable seal extends the entire distance between the top horizontal seal and the bottom horizontal seal, or at most a portion of the distance between the top horizontal seal and the bottom horizontal seal in other embodiments.

The recloseable seal extends in a vertical direction or in a direction between vertical and horizontal in various embodiments.

The bag has sealed horizontal sides and is formed from a flat strip in another embodiment. The recloseable seal is fixed to the sealed horizontal sides or to a portion of the strip other than the sealed horizontal sides.

The bag has a handle portion above--the top horizontal seal in an alternative embodiment. The handle has a hole in it.

The bag has a curved cross-section, and/or a cross-section with corners in other embodiments.

The recloseable seal includes a finger closure zipper or a slide zipper in other embodiments.

The bag has sealed non-vertical sides and is formed from a flat strip in another embodiment. A notch extends along a length of the sealed sides, and the recloseable seal is fixed to the notch.

According to a third aspect of the invention a method of making a vertical form fill seal bag includes forming a hollow strip and moving the hollow strip in a vertical direction. The hollow strip is sealed to create a horizontal bottom seal and the bag is filled with contents. The hollow strip is sealed to create a top horizontal seal. A recloseable seal is applied to the bag, and the seal extends in a direction other than horizontal, and for a distance less than from the bottom seal to the top seal. The bag is separated from the hollow strip.

According to a fourth aspect of the invention a vertical form fill seal bag includes a hollow interior and a horizontal bottom seal located below the hollow interior. A top horizontal seal is located above the hollow interior. A recloseable seal extends between the top and bottom seals in a direction other than horizontal, and for a distance less than from the bottom seal to the top seal.

According to a fifth aspect of the invention a method of making a vertical form fill seal bag includes forming a hollow strip and moving the hollow strip in a vertical direction. The hollow strip is sealed on a generally horizontal line, thus creating a horizontal bottom seal. The bag is filled with contents, and a top horizontal seal is created. A recdoseable seal is affixed to the bag. A handle is formed above the top horizontal seal (and not filled with contents) and a hole is made in the handle. The bag is separated from the hollow strip.

According to a sixth aspect of the invention a vertical form fill seal bag includes a hollow interior defined by a top horizontal, a bottom horizontal seal, and side walls. A recloseable seal extends between the top and bottom seals. A handle with a hole is located above the top seal.

According to a seventh aspect of the invention a method of making a vertical form fill seal, bag includes forming a hollow strip and moving the hollow strip in a vertical direction. The hollow strip is sealed to create a horizontal bottom seal and the bag is filled with contents. The hollow strip is sealed again to create a top horizontal seal. A recloseable seal is affixed or applied to the bag in a direction other than horizontal or vertical. The bag is separated from the hollow strip.

According to an eighth aspect of the invention a vertical form fill seal, bag includes a hollow interior is defined by a horizontal bottom seal (located below the hollow interior), and a top horizontal seal located above the hollow interior. A recloseable seal extends between the is top and bottom seals in a direction other than horizontal or vertical.

Other principal features and advantages of the invention will become apparent to those skilled in the art upon review of the following drawings, the detailed description and the appended claims.

BRIEF DESCRIPTION OF THE DRAWINGS

FIG. 9 shows a perspective view of a bag in accordance with one embodiment of the present invention;

FIG. 10 shows a perspective view of a bag in accordance with one embodiment of the present invention.

Figure 1:
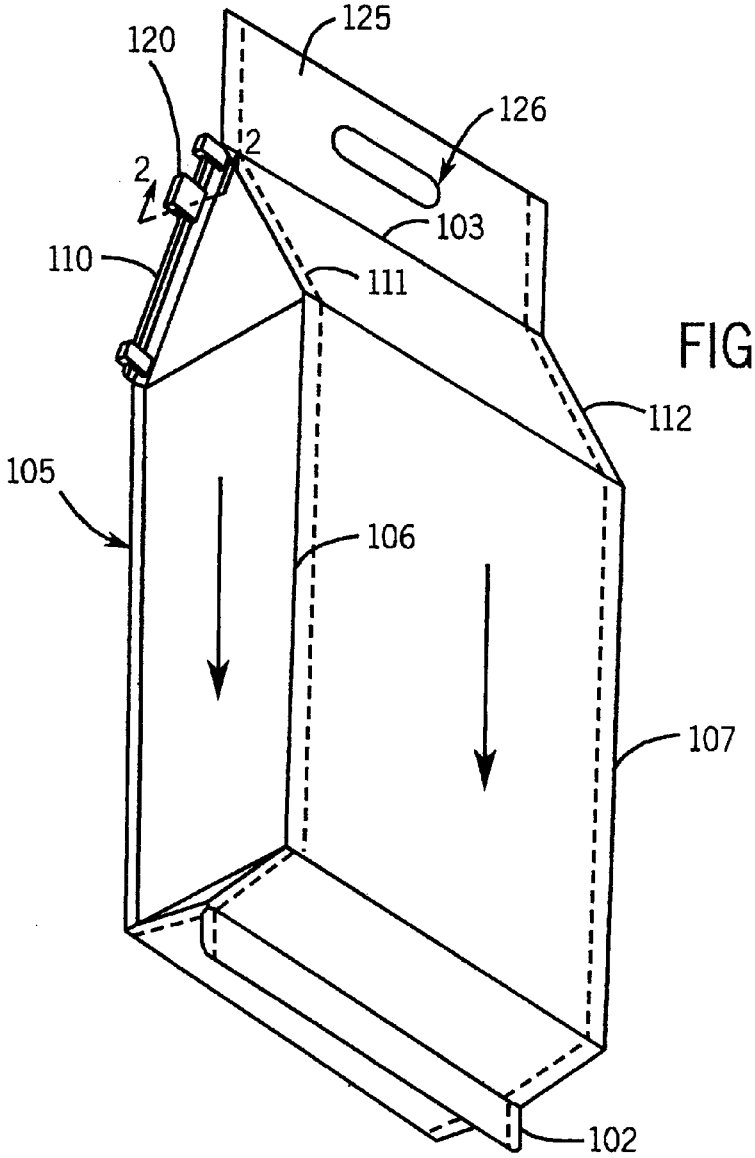
FIG. 1 shows perspective view of a bag in accordance with one embodiment of the present invention.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

While the present invention will be illustrated with reference to particular bag types, seals, and machinery, it should be understood at the outset that the invention can also be implemented with other bag types, seals and machinery.

Generally, the present invention provides for bags having a resealable closure that is easy to pour from and economical to make. The resealable closure is preferably a zipper extending in the longitudinal direction, starting near the top seal, and extending only partially down towards the bottom seal, to allow for easy pouring without spilling. The bag is preferably a stand-up bag, although pillow bags and pre-pouches are used in alternative embodiments. Only the necessary amount of zipper need be affixed to the bag, thus it is economical to make. Also, productions speeds should be more easily increased. A handle is included to make it allow the user to hold while pouring in one embodiment, thus making it easier to pour with, particularly when the bag is large and heavy.

Referring now to FIG. 1, a perspective view of a bag 100 constructed in accordance with the present invention is shown. Bag 100 is a square bottom, stand-up bag, including a bottom, generally horizontal, seal 102 and a top, generally horizontal, seal 103. Bottom, top and horizontal directions are relative to a typical vertical form fill an seal bag, where the bag is filled from a generally vertical tube, but do not mean precisely in a certain direction, rather generally in that direction. Also, vertical can mean machine direction. The bottom is the end of the bag on which the bag stands after filling (for a stand-up bag). The bag is said to stand on the bottom seal when the bottom seal is near the surface on which that bag stands. Four longitudinal or vertical edge seals (three are shown as 105–107) are provided to create the corners which give the bag the rectangular cross-section. The seals may be made as described in the prior art above, or in any other way,that is practical and economical.

Near the top of the bag the left seals 110 and 111 angle toward one another to intersect at top seal 103, as do the right seals (one of which is shown as 112) when bag 100 is filled with product. Thus, seals 110–112 are generally vertical, when sealed, and may be slightly off vertical after bag 100 is filled with product. A slide zipper 120 is fastened using known techniques, such as ultrasonic welding, heating, etc., along part or all of seal 110.

Figure 2:
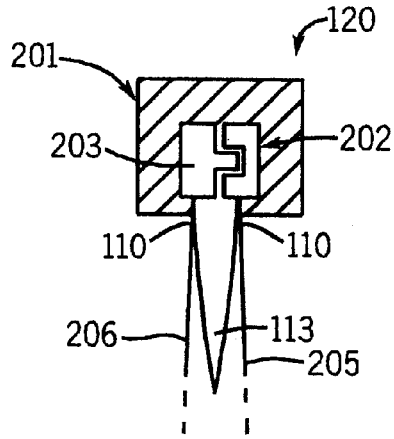
FIG. 2 is a sectional view taken along lines 2—2 of FIG. 1.

Slide zipper 120 can be seen in more detail in FIG. 2, which is a sectional view taken along lines 2—2 of FIG. 1. Slide zipper 120 includes a slider closure 201, and a pair of fastener strips 202 and 203, shown with a seal 110 near a pair of sides 205 and 206 of bag 100.

The closure is opened and closed by sliding slider closure 201. A tamper proof film 113 is preferably scored for easy opening, and to show evidence of tampering if opened prematurely. Slide zipper 120 is exemplary, and other known resealable closures, including other slide zippers or finger zipper closures may be used.

Referring again to FIG. 1, a handle portion 125 is disposed above top seal 103. Handle portion 125 includes a hole 126 for ease of holding bag 100. Thus, to pour the user can open the resealable closure using slide zipper 120, and hold bag 100 using handle 125–126.

Thus, a resealable closure that is not horizontal, and does not extend the length of the entire bag is provided, and can be sized for the specific bag application. This reduces zipper cost and helps preventing spillage. Also, the zipper location allows bag 100 to be stored in an up-right standing position with or without the zipper closed without product spillage, and the contents do not fill thru the zipper area thus reducing zipper contamination and increasing seal integrity. Because less zipper is applied, the process flow would preferably be faster, increasing production speeds. In alternative embodiments the invention is implemented with on pre-made pouches, tubular style, bottom sealed, pouches, and/or with finger closure zippers. The present invention may also be implemented with a wide variety of bag dimensions. The seals 105, 106, and 107 are 7⁄32 inch seals for one exemplary bag.

Figure 11:
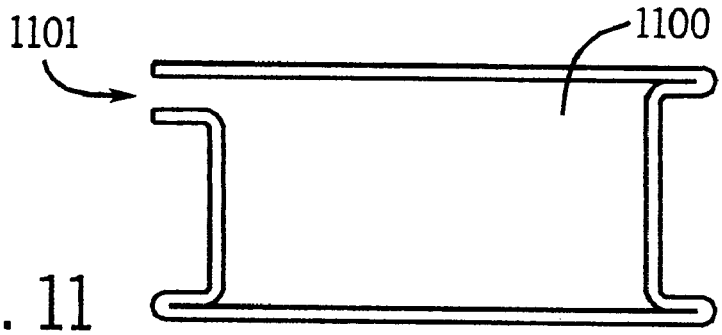
FIGS. 11–13 show examples of seals to which a zipper may be attached.
Figure 12:
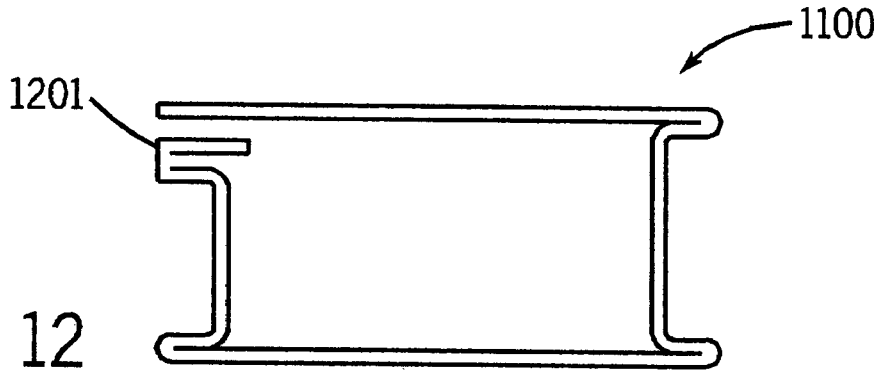
Figure 13:
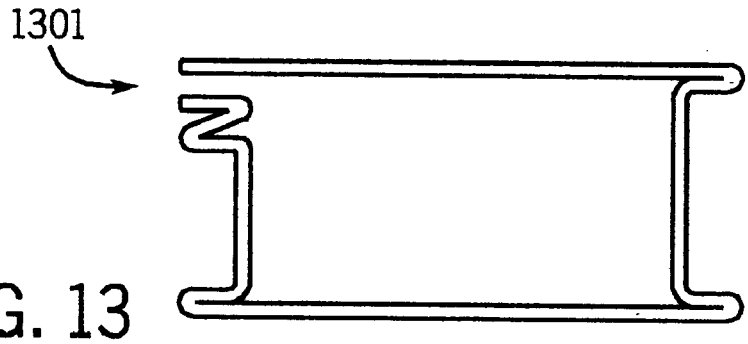

The bag is preferably made by directing a flat strip or film of plastic to a vertical tube. The arrow on each bag shown indicates the process flow direction. The film is wrapped around the tube and the edges are sealed, thus creating a hollow tube. Hollow strip, or hollow tube, as used herein, refers to a film where the sides are closed, such that the cross section is a closed shape, curved, rectangular, etc. FIGS. 11–13 show 3 styles of sealing the edge of the strip to create the hollow strip. A tube 1100 is shown in FIG. 11 and includes a fin seal 1101. A zipper or other closure can be affixed to this seal. Likewise, FIG. 12 shows a lap seal 1201, and FIG. 13 a modified lap seal 1301. The hollow strip may be provided directly to the vertical tube (i.e., closed before reaching the tube), in an alternative embodiment. The bottom of the bag is made by sealing, horizontally, across the hollow strip. The bag is filed with contents, and a top horizontal seal is made. The resealable closure is applied to the appropriate portion of the side seal. Because the bag is not filled through the resealable closure, the resealable closure will preferably be cleaner. The bag is separated (perhaps at a later time) from the rest of the strip. Some bags are pre-made, and filled at a later time.

Figure 3:
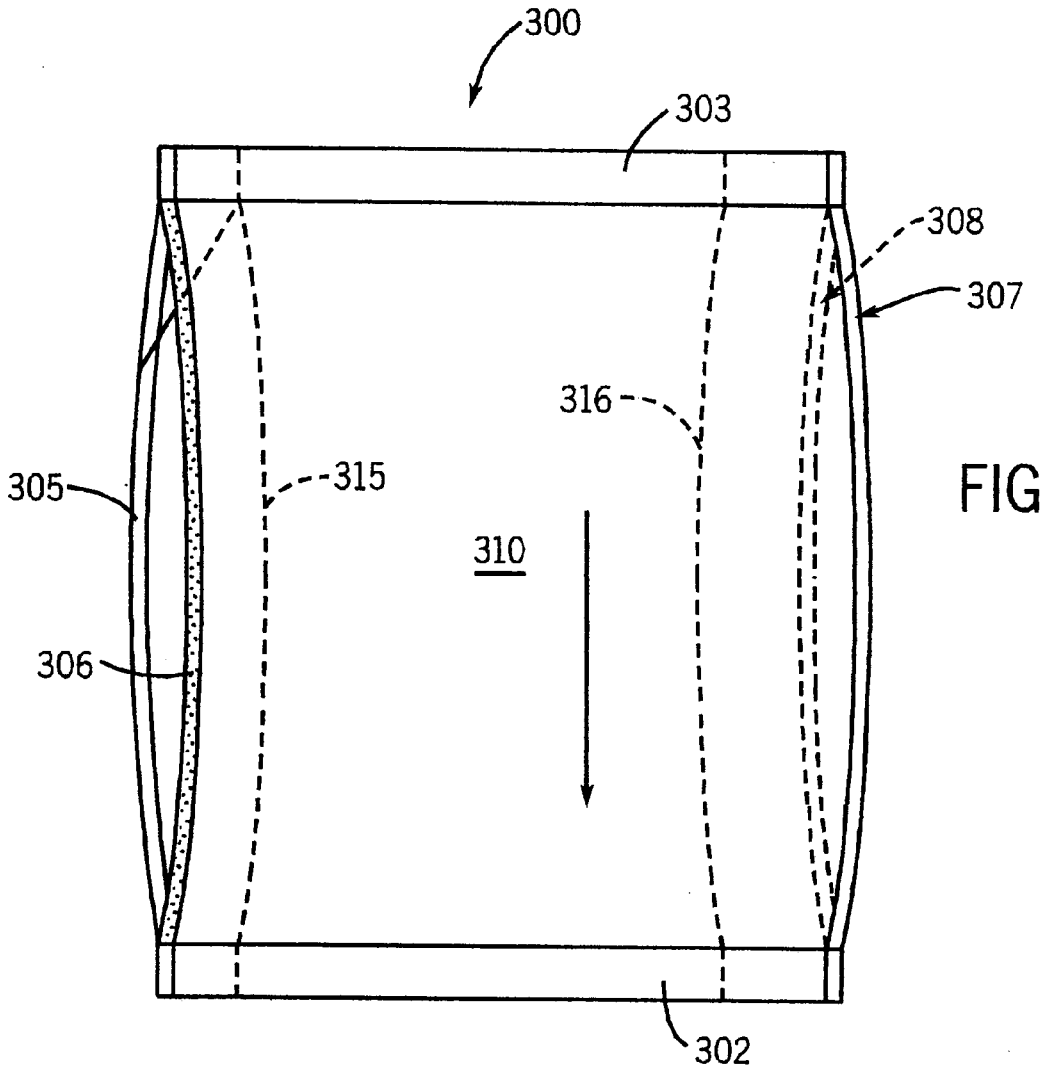
FIG. 3 shows a perspective view of a bag in accordance with one embodiment of the present invention.

FIG. 3 shows a perspective view of a pillow bag 300 constructed in accordance with one embodiment of the present invention. A bottom seal 302 and a top seal 303 are formed in a known manner. A plurality of longitudinal seals 305, 307 and 308 are also formed in a known manner. A longitudinal seal 306 is formed to have a resealable closure applied thereto. Gussets 315 and 316 are also shown. Gusset 315 is sealed, at least near top seal 303, in one embodiment to allow the contents to flow without getting trapped behind the rear gusset.

The seals are formed such that bag 300 is a pillow bag. The resealable closure is shown as extending the entire distance between top seal 303 and bottom seal 302, although it extends a lesser distance in other embodiments. Bag 100 may have corner seals that angle in, as shown on bag 100.

Additionally,the bag can be rotated 90 degrees, such that seals 307 and 308 are the "bottom" of bag 300. If bag 300 is made as a stand-up bag, then it will also stand up in this orientation. It may be recognized that an entire face 310 of bag 300 is available for printing thereon. Also, the print may be oriented either vertically or horizontally, since bag 300 is a stand-up bag in both orientations. This is also true of bag 100 described above, and the bags described below with referenced to FIGS. 4–10. In the "side" orientation a resealable closure may thus be applied to a portion of full top width of the bag, thus reducing zipper cost.

Figure 4:
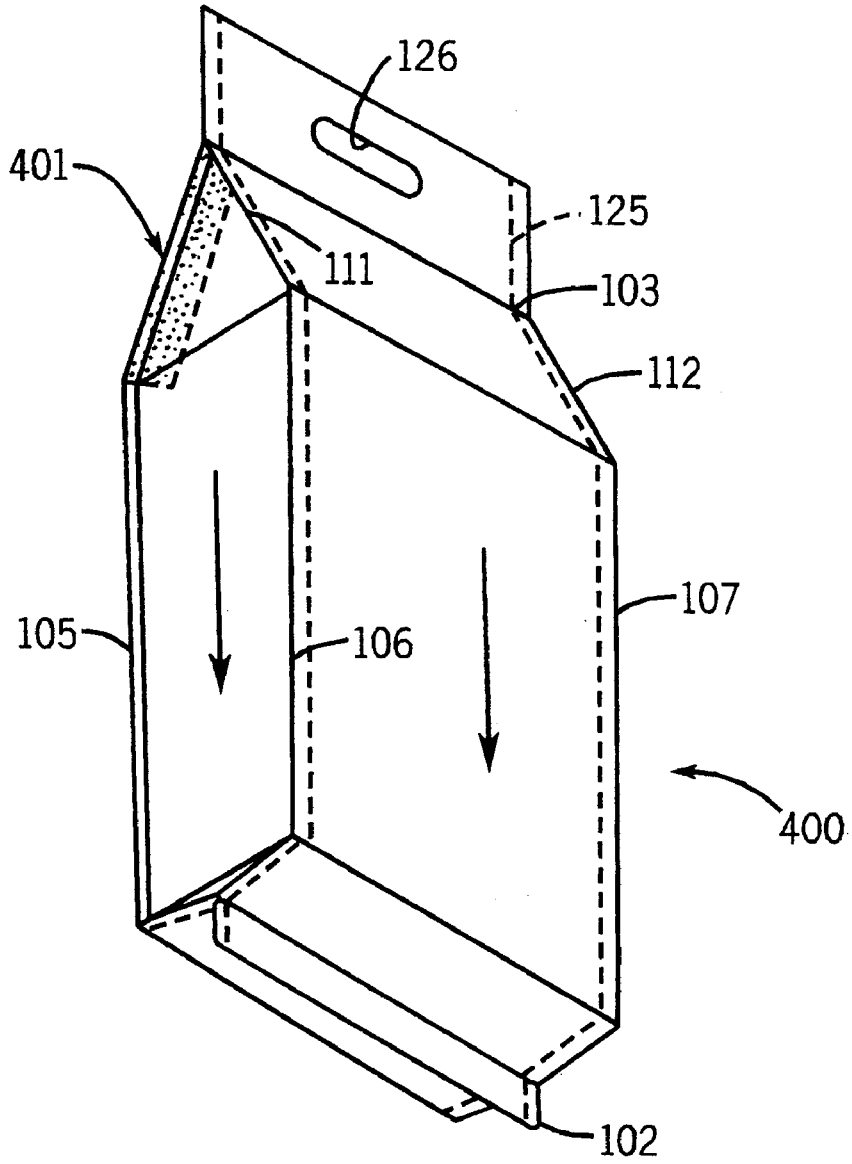
FIG. 4 shows a perspective view of a bag before a resealable closure is attached in accordance with one embodiment of the present invention.
Figure 5:
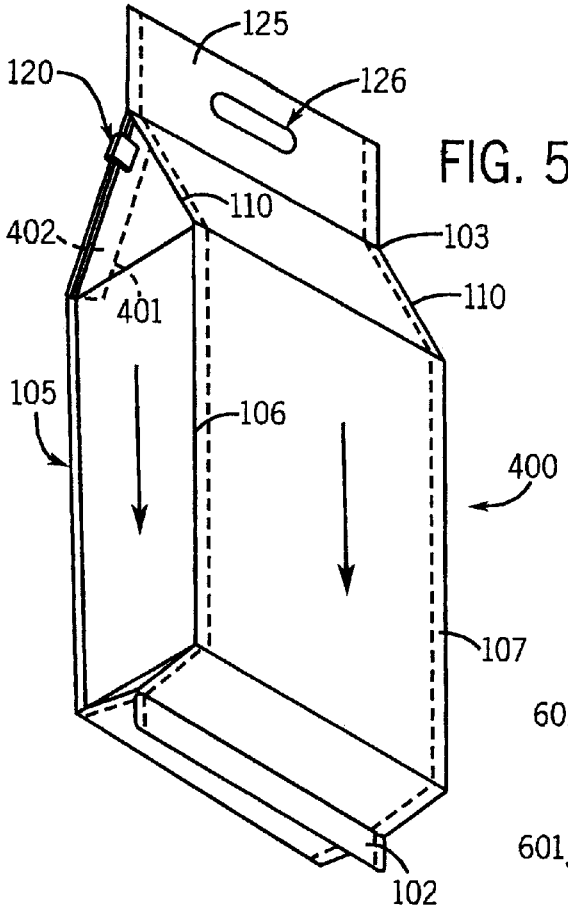
FIG. 5 shows a perspective view of the bag of FIG. 4 with a resealable closure attached in accordance with one embodiment of the present invention.

It may be readily seen that bags 100 and 300 have a zipper that protrudes beyond the seal from the edge of the bag. FIGS. 4 and 5 show an embodiment where the zipper is flush with the seal edge. Referring first to FIG. 4 a bag 400, without a resealable closure attached is shown and has much of the structure the same as bag 100 (FIG. 1). However, a notch 401 is shown cut away from where seal 110 had been in FIG. 1.

A resealable closure 402 (fastener strips with slide zipper 120 in the preferred embodiment) is attached where notch 401 is cut away. Notch 401 is sized such that closure 402 is flush with the edges of bag 400 (seals 105 and 110 e.g.).

Figure 6:
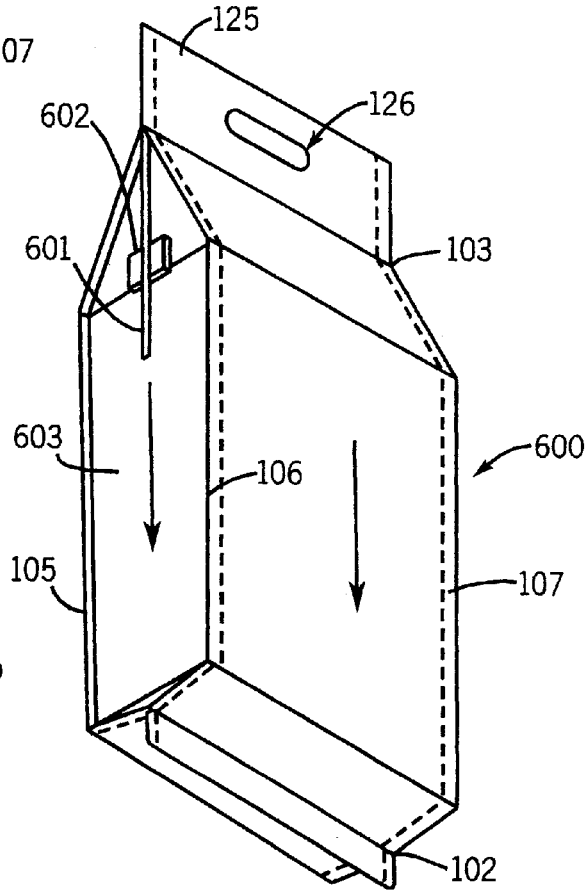
FIG. 6 shows a perspective view of a bag in accordance with one embodiment of the present invention.

FIG. 6 shows a perspective view of a bag 600 having a resealable closure 601, for example a zipper closure, located in the middle of a gusseted side 603. Zipper closure 601 and slide zipper 602 may be constructed as slide zipper 120, in other known or ways, or any construction suitable for resealing. It may be readily seen that closure 601 provides for easy pouring from bag 600.

Figure 7A:
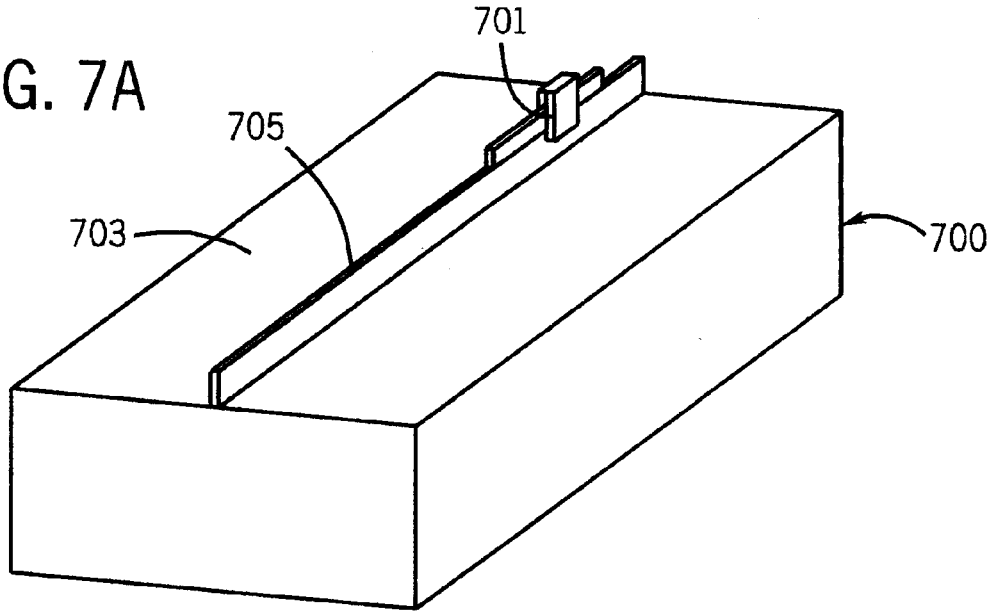
FIG. 7A shows another perspective view of the bag of FIG. 7.
Figure 7:
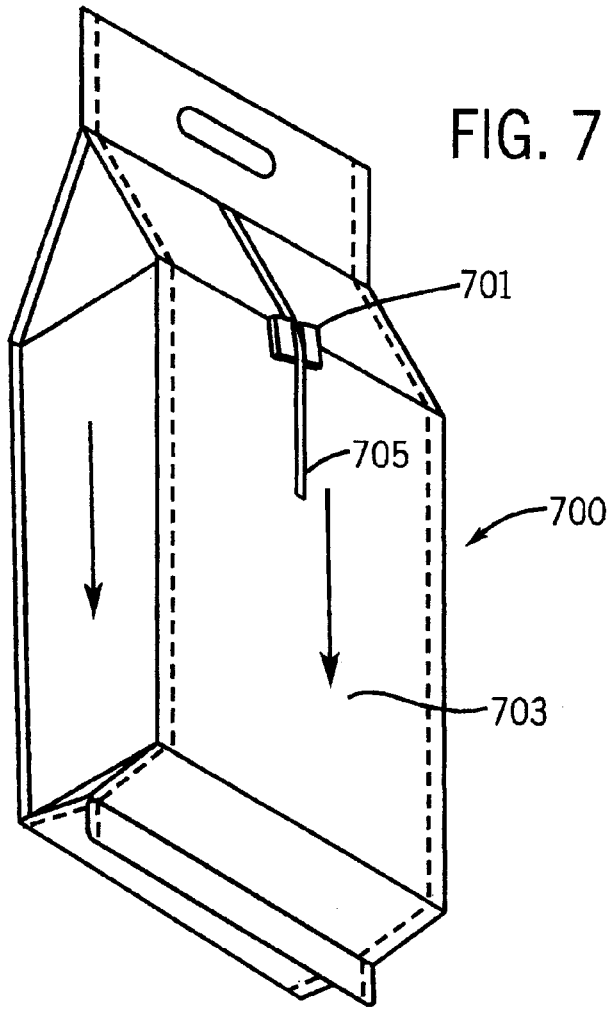
FIG. 7 shows a perspective view of a bag in accordance with one embodiment of the present invention.

FIG. 7 shows a perspective view of a bag 700 having a resealable closure 705 with a slide zipper 701 located in the middle of a non-gusseted side 703. The remaining features of bag 700 may be as in the previously described embodiments. Likewise, FIG. 7A shows another view of a bag with the resealable closure on a non-gusseted side.

Figure 8:
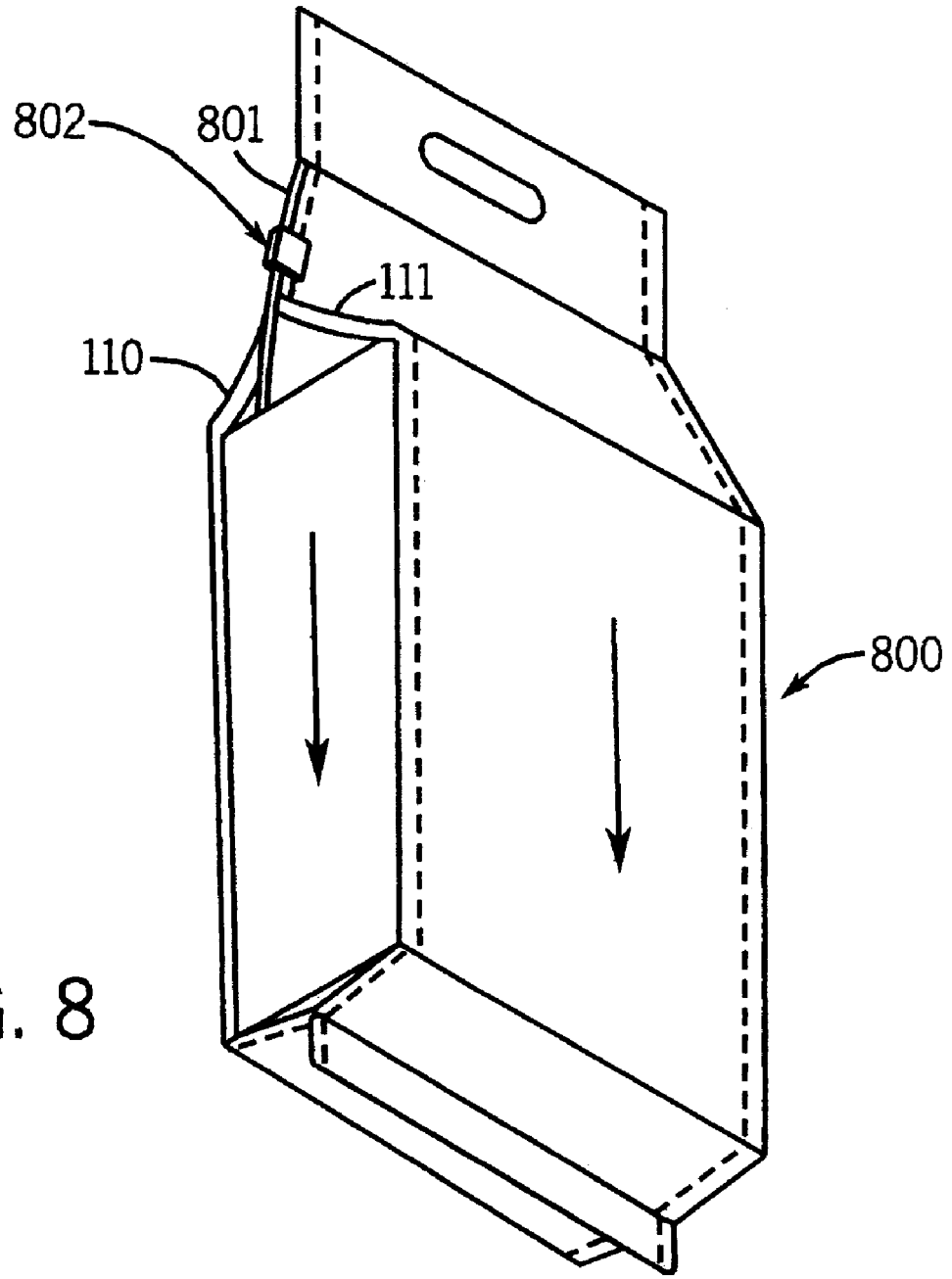
FIG. 8 shows a perspective view of a bag in accordance with one embodiment of the present invention.

FIG. 8 shows a perspective view of a bag 800 having a resealable closure 801 joining upper seals 110 and 111. Bag 800, zipper closure 801 and slide zipper 802 may be constructed as described above. Bag 800 thus requires an angular corner cut, and closure 801 is then attached to the angled edges of bag 800.

Generally, the bags shown are able to stand-up, be easily poured, economical to make, and use only so much zipper as required for the product. However, these bags are made using pillow style pouches in alternative embodiments. Additionally, features shown may be omitted, such as the side closure, the handle, the stand-up bag, the notch, etc. Also, finger zipper closures, or other resealable closures, be used.

FIG. 9 shows a perspective view of a typical side seal style bag 900 having sides seals 901-904, but made in accordance with one embodiment of this invention. Bag 900 may be made in a manner consistent with the prior art, or in other manners. However, a resealable closure 906, unlike the prior art, is affixed to and extends along only a portion of side seal 901. Machine direction is preferably from side 904 to side seal 902, such that resealable closure 906 may be affixed using existing equipment (modified to apply only a closure extending only part of the length of side seal 901).

FIG. 10 shows a perspective view of a typical pillow pouch style bag 1000 having sides a top seal 1002, a bottom seal 1001, and a back seal 1003, but made in accordance with one embodiment of this invention. Bag 1000 may be made in a manner consistent with the prior art, or in other manners. However, a resealable closure 1006, unlike the prior art, is affixed to and extends along only a portion of back seal 1003. Machine direction is preferably from top seal 1002 to bottom seal 1001, such that resealable closure 1006 may be affixed using existing equipment (modified to apply a closure extending only part of the length of back seal 1003).

Bags 100–1000, or other bags embodying the invention, may be constructed using known techniques such as those shown in the prior art recited above, or using other techniques to apply the resealable closures. For example, the techniques and equipment described in the prior art incorporated by reference may be adapted to implement this invention.

Numerous modifications may be made to the present invention which still fall within the intended scope hereof. Thus, it should be apparent that there has been provided in accordance with the present invention a novel bag and a method of making such a bag that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A method of making a vertical form fill seal, stand-up, bag comprising:

forming a hollow strip;

moving the hollow strip in a vertical direction;

sealing the hollow strip to create a horizontal bottom seal of the bag, on which the bag can stand when filled with contents;

filling the bag with the contents; applying a recloseable seal, in a direction other than horizontal, to the bag;

sealing the hollow strip to create a top horizontal seal; and separating the bag from the hollow strip;

wherein applying a recloseable seal includes applying the recloseable seal for at most a portion of the distance between the top horizontal seal and the bottom horizontal seal.

2. The method of claim 1, wherein forming a hollow includes forming a flexible and resilient hollow strip.

3. The method of claim 1, wherein forming a hollow strip includes forming a plastic hollow strip.

4. The method of claim 1, wherein forming a hollow strip includes sealing horizontal sides of a flat strip, further including reorienting the bag so that the sealed sides are no longer horizontal; and further wherein applying a recloseable seal includes applying the recloseable seal to the sealed sides.

5. A method of making a vertical form fill seal, stand-up, bag comprising:

forming a hollow strip;

moving the hollow strip in a vertical direction;

sealing the hollow strip to create a horizontal bottom seal of the bag, on which the bag can stand when filled with contents;

filling the bag with the contents;

applying a recloseable seal, in a direction other than horizontal, to the bag;

sealing the hollow strip to create a top horizontal seal; and separating the bag from the hollow strip wherein applying a recloseable seal includes applying the recloseable seal in a direction between vertical and horizontal.

6. A method of making a vertical form fill seal, stand-up, bag comprising:

forming a hollow strip;

moving the hollow strip in a vertical direction;

sealing the hollow strip to create a horizontal bottom seal of the bag, on which the bag can stand when filled with contents;

filling the bag with the contents;

applying a recloseable seal, in a direction other than horizontal, to the bag;

sealing the hollow strip to create a top horizontal seal; and separating the bag from the hollow strip wherein forming a hollow strip includes sealing horizontal sides of a flat strip and creating a notch extending along a length of the sealed horizontal sides, and further wherein applying a recloseable seal includes applying the recloseable seal to the notch.

7. A method of making a vertical form fill seal bag comprising:

forming a hollow strip;

moving the hollow strip in a vertical direction;

sealing the hollow strip to create a horizontal bottom seal;

filling the bag with contents;

sealing the hollow strip to create a top horizontal seal;

applying a recloseable seal to the bag, wherein the seal extends in a direction other than horizontal, and further extends a distance less than from the bottom seal to the top seal; and separating the bag from the hollow strip.

8. The method of claim 7, wherein applying a recloseable seal includes applying the recloseable seal in a vertical direction.

9. The method of claim 7, further comprising:

forming a handle portion above the top horizontal seal that is not filled with contents; and creating a hole in the handle portion.

10. The method of claim 7, wherein forming a hollow strip includes forming a hollow strip having a curved cross-section.

11. The method of claim 7, wherein forming a hollow strip includes forming a hollow strip having a cross-section with corners.

12. The method of claim 7, wherein forming a hollow strip includes sealing horizontal sides of a flat strip and further wherein applying a recloseable seal includes applying the recloseable seal to a portion of the strip other than the sealed horizontal sides.

13. The method of claim 7, wherein applying a recloseable seal includes applying a finger closure zipper.

14. The method of claim 7, wherein applying a recloseable seal includes applying a slide zipper.

15. A method of making a vertical form fill seal, bag comprising:

forming a hollow strip;

moving the hollow strip in a vertical direction;

sealing the hollow strip to create a horizontal bottom seal;

filling the bag with contents;

applying a recloseable seal to the bag in a direction other than horizontal or vertical;

sealing the hollow strip to create a top horizontal seal; and separating the bag from the hollow strip.

16. The bag of claim 15, wherein the bag is further comprised of a flexible and resilient material.

17. The bag of claim 15, wherein the bag is further comprised of a plastic material.

18. The bag of claim 15, further comprising a handle portion with a hole therein, disposed above the top horizontal seal.

19. The bag of claim 15, wherein the hollow interior has a curved cross-section.

20. The bag of claim 15, wherein the hollow interior has a cross-section with corners.

21. The bag of claim 15, wherein the recloseable seal includes a finger closure zipper.

* * * * *